US011195444B2

(12) United States Patent
Kim et al.

(10) Patent No.: US 11,195,444 B2
(45) Date of Patent: Dec. 7, 2021

(54) DISPLAY DEVICE

(71) Applicant: Samsung Display Co., Ltd., Yongin-si (KR)

(72) Inventors: Keun Woo Kim, Yongin-si (KR); Tae Wook Kang, Yongin-si (KR); Hye Na Kwak, Yongin-si (KR); Doo Na Kim, Yongin-si (KR); Han Bit Kim, Yongin-si (KR); Bum Mo Sung, Yongin-si (KR); Do Kyeong Lee, Yongin-si (KR); Yong Su Lee, Yongin-si (KR); Jae Hwan Chu, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/038,256

(22) Filed: Sep. 30, 2020

(65) Prior Publication Data

US 2021/0150960 A1 May 20, 2021

(30) Foreign Application Priority Data

Nov. 15, 2019 (KR) ..... 10-2019-0146585

(51) Int. Cl.
*G09G 3/20* (2006.01)

(52) U.S. Cl.
CPC ..... *G09G 3/20* (2013.01); *G09G 2310/0267* (2013.01)

(58) Field of Classification Search
CPC ..... G09G 3/20; G09G 2310/0267; G09G 2310/0286; G09G 3/3266; G09G 3/32; G09G 3/3406; G09G 2320/062; H01L 27/32
See application file for complete search history.

(56) References Cited

U.S. PATENT DOCUMENTS

| | | | | |
|---|---|---|---|---|
| 9,337,343 | B2 * | 5/2016 | Yamazaki | G02F 1/136277 |
| 9,362,412 | B2 * | 6/2016 | Umezaki | H01L 27/1255 |
| 2018/0040274 | A1 * | 2/2018 | Kurokawa | G09G 3/3275 |
| 2018/0190204 | A1 * | 7/2018 | Shin | G11C 19/28 |
| 2018/0350995 | A1 * | 12/2018 | Kim | H01L 29/24 |
| 2021/0057502 | A1 | 2/2021 | Kim et al. | |

FOREIGN PATENT DOCUMENTS

KR 10-2021-0022807 A 3/2021

* cited by examiner

*Primary Examiner* — Andrew Sasinowski
(74) *Attorney, Agent, or Firm* — Lewis Roca Rothgerber Christie LLP

(57) ABSTRACT

A display device includes: a pixel unit including a plurality of pixels; a scan driver having a plurality of stages and configured to supply a scan signal to the pixel unit; and a light emission control driver having a plurality of stages and configured to supply a light emission control signal to the pixel unit, wherein a first transistor of a plurality of transistors included in at least one of the stages of the scan driver or the stages of the light emission control driver comprises: an active layer pattern on a base layer, and including a channel region forming a channel, and first and second regions on opposite sides of the channel region; and a gate electrode spaced apart from the active layer pattern with a first insulating film therebetween, and overlapping the channel region.

20 Claims, 15 Drawing Sheets

DISPLAY DEVICE

CROSS-REFERENCE TO RELATED APPLICATION

The present application claims priority to and the benefit of Korean Patent Application No. 10-2019-0146585, filed on Nov. 15, 2019, the entire content of which is herein incorporated by reference.

BACKGROUND

1. Field

Aspects of some example embodiments of the present disclosure relate to a display device.

2. Description of the Related Art

Display devices provide a connection medium between user and information. Accordingly, use of display devices such as liquid crystal display device (LCD), organic light emitting display devices (OLEDs), and plasma display panels (PDPs) has been increasing.

Each pixel of a display device may emit light at a luminance corresponding to a data voltage supplied through a data line. The display device may display an image frame with a light emission combination of the pixels.

A plurality of pixels may be connected to each data line. Therefore, a scan driver that provides a scan signal for selecting a pixel to which a data voltage is to be supplied among the plurality of pixels is required. The scan driver may be configured of a stage including a plurality of transistors to sequentially provide a scan signal of a turn-on level in a scan line unit. In addition, the light emission control driver may provide a light emission control signal to a pixel unit through a light emission control line.

The above information disclosed in this Background section is only for enhancement of understanding of the background and therefore the information discussed in this Background section does not necessarily constitute prior art.

SUMMARY

Aspects of some example embodiments of the disclosure relate to a display device, and for example, to a display device including a stage of a scan driver or a light emission control driver.

Aspects of some example embodiments according to the present disclosure include a display device including a transistor that is relatively robust to a hot carrier instability (HCI) phenomenon.

According to some example embodiments of the disclosure, a display device includes a transistor that may be capable of preventing or reducing instances of a driving current reduction.

However, the characteristics of embodiments according to the present disclosure are not limited to the above-described characteristics, and embodiments may be variously expanded without departing from the spirit and scope of embodiments according to the present disclosure.

According to some example embodiments, a display device may include a pixel unit including a plurality of pixels, a scan driver configured of a plurality of stages to supply a scan signal to the pixel unit, and a light emission control driver configured of a plurality of stages to supply a light emission control signal to the pixel unit.

According to some example embodiments, a first transistor of a plurality of transistors included in at least one of the stages of the scan driver and the stages of the light emission control driver may include an active layer pattern on a base layer, and including a channel region forming a channel, and first and second regions on both sides of the channel region, and a gate electrode spaced apart from the active layer pattern with a first insulating film therebetween, and overlapping the channel region, and a channel width of the channel region may be narrower than a channel width of at least one of remaining transistors of the plurality of transistors.

According to some example embodiments, the first transistor may include a first sub transistor and a second sub transistor connected in parallel with each other.

According to some example embodiments, a channel width of the first sub transistor may be narrower than a channel width of the second sub transistor, and a channel length of the first sub transistor may be shorter than a channel length of the second sub transistor.

According to some example embodiments, the first sub transistor and the second sub transistor may share the gate electrode with each other, and the gate electrode may include a first gate region having a first width corresponding to the channel length of the first sub transistor and a second gate region having a second width corresponding to the channel length of the second sub transistor and longer than the first width.

According to some example embodiments, at least one of the first region and the second region may be divided into a region of the first sub transistor and a region of the second sub transistor spaced apart from the region of the first sub transistor.

According to some example embodiments, the first sub transistor and the second sub transistor may share the single first region and share the single second region.

According to some example embodiments, the first transistor may include a first sub transistor, and a second sub transistor and a third sub transistor having a common gate electrode and connected in series with each other.

According to some example embodiments, a channel width of the first sub transistor may be narrower than a channel width of the second sub transistor or a channel width of the third sub transistor.

According to some example embodiments, a channel width of the second sub transistor may be equal to a channel width of the third sub transistor.

According to some example embodiments, channel lengths of the first sub transistor, the second sub transistor, and the third sub transistor may be less than a channel length of at least one of the remaining transistors.

According to some example embodiments, the first sub transistor, the second sub transistor, and the third sub transistor may share the gate electrode with each other, and the gate electrode may include a first gate region having a first width corresponding to the channel length of the first sub transistor, a second gate region having a second width corresponding to the channel length of the second sub transistor, and a third gate region having a third width corresponding to the channel length of the third sub transistor.

According to some example embodiments, the gate electrode may further include a fourth gate region connecting the first gate region, the second gate region, and the third gate region to each other.

According to some example embodiments, the first sub transistor and the second sub transistor may share the single first region, and the first sub transistor and the third sub transistor may share the single second region.

According to some example embodiments, the gate electrode may include a portion having a shape of an uppercase alphabetic letter CT'.

According to some example embodiments, the first transistor may include a first sub transistor and a second sub transistor connected in parallel with each other, and a third sub transistor connected in series with the first sub transistor and the second sub transistor.

According to some example embodiments, a channel width of the first sub transistor and the second sub transistor may be narrower than a channel width of the third sub transistor.

According to some example embodiments, channel lengths of the first sub transistor, the second sub transistor, and the third sub transistor may be less than a channel length of at least one of the remaining transistors.

According to some example embodiments, the first sub transistor, the second sub transistor, and the third sub transistor may share the gate electrode with each other, and the gate electrode may include a first gate region overlapping a channel region of the first sub transistor and a channel region of the second sub transistor, and a second gate region overlapping a channel region of the third sub transistor.

According to some example embodiments, the second gate region may be connected to the first gate region.

According to some example embodiments, the first transistor may include a first sub transistor and a second sub transistor connected in parallel with each other, the second sub transistor may further include a bottom gate electrode spaced apart from the gate electrode, the first insulating film, and the active layer pattern, and a channel width of the first sub transistor may be narrower than a channel width of the second sub transistor.

According to some example embodiments, a display device may include a pixel unit including a plurality of pixels, a scan driver configured of a plurality of stages to supply a scan signal to the pixel unit, and a light emission control driver configured of a plurality of stages to supply a light emission control signal to the pixel unit.

According to some example embodiments, a first transistor of a plurality of transistors included in at least one of the stages of the scan driver and the stages of the light emission control driver may include an active layer pattern including a channel region on a buffer layer to form a channel, and first and second regions on both sides of the channel region, and a gate electrode spaced apart from the active layer pattern with a first insulating film therebetween, and overlapping the channel region.

According to some example embodiments, the channel region may include a first edge region and a second edge region positioned at both side surfaces of the channel region based on a channel width, and a bulk region positioned between the first edge region and the second edge region.

According to some example embodiments, the first insulating film may have a thickness of a region overlapping the bulk region, which is thicker than a thickness of a region overlapping with first edge region or the second edge region.

According to some example embodiments, the display device according to the disclosure may have a characteristic that is robust to an HCl phenomenon by configuring a stage circuit having a reduced channel width of a transistor.

In addition, because the stage circuit is configured based on a transistor having a reduced channel length or channel width, the circuit area may be reduced.

BRIEF DESCRIPTION OF THE DRAWINGS

The above and other characteristics of embodiments according to the present disclosure will become more apparent by describing in further detail aspects of example embodiments thereof with reference to the accompanying drawings, in which.

DETAILED DESCRIPTION

Figure 1:
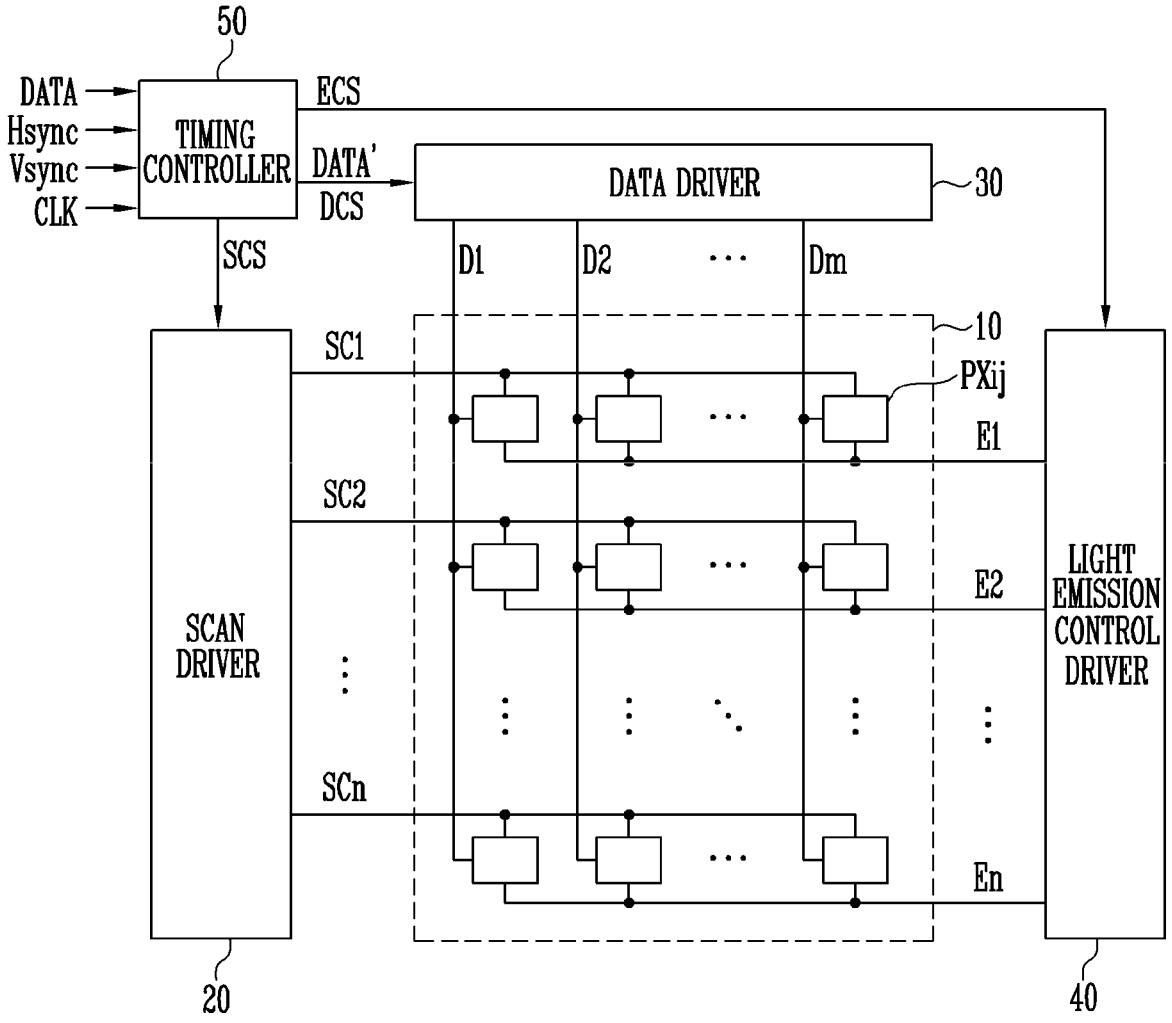
FIG. 1 is a diagram for describing a display device according to some example embodiments of the disclosure.

Hereinafter, various embodiments of the disclosure will be described in more detail with reference to the accompanying drawings so that those skilled in the art may more easily carry out embodiments according to the present disclosure. Embodiments according to the disclosure may be implemented in various different forms and are not limited to the example embodiments described herein.

In order to more clearly describe the disclosure, descriptions of certain aspects or components that are not necessary to enable a person having ordinary skill in the art to make and use the embodiments may be omitted, and the same or similar components are denoted by the same reference numerals throughout the specification. Therefore, the above-described reference numerals may be used in other drawings.

In addition, sizes and thicknesses of each component shown in the drawings are arbitrarily shown for convenience of description, and thus the disclosure is not necessarily limited to those shown in the drawings. In the drawings, thicknesses may be exaggerated to clearly express various layers and regions.

FIG. 1 is a diagram for describing a display device according to some example embodiments of the disclosure.

Referring to FIG. 1, the display device according to some example embodiments of the disclosure may include a pixel unit 10, a scan driver 20, a data driver 30, a light emission control driver 40, and a timing controller 50.

The pixel unit 10 includes a plurality of pixels PXij connected to scan lines SC1 to SCn, data lines D1 to Dm, and the light emission control lines E1 to En and arranged in a matrix form. The pixels PXij receive a scan signal through the scan lines SC1 to SCn, receive a data signal through the data lines D1 to Dm, and receive a light emission control signal through the light emission control lines E1 to En. The pixels PXij emit light at a luminance corresponding to the data signal supplied from the data lines D1 to Dm when the scan signal is supplied from the scan lines SC1 to SCn.

The scan driver 20 is connected to the plurality of scan lines SC1 to SCn, generates the scan signal in response to a scan driving control signal SCS of the timing controller 50, and outputs the generated scan signal to the scan lines SC1 to SCn. The scan driver 20 may include a plurality of stage circuits. The scan driver 20 may sequentially provide a scan signal having a pulse of a turn-on level to the scan lines SC1 to SCn through the scan lines SC1 to SCn. The scan driver 20 may be configured in the form of a shift register. At this time, the stage circuit of the scan driver 20 may include a plurality of transistors and/or a plurality of capacitors.

The data driver 30 is connected to the plurality of data lines D1 to Dm, generates data signals based on a data driving control signal DCS and image data DATA' of the timing controller 50, and outputs the generated data signals to the data lines D1 to Dm. The data signals supplied to the data lines D1 to Dm are supplied to the pixels PXij selected by the scan signal whenever the scan signal is supplied. Then, the pixels PXij may charge a voltage corresponding to the data signal.

The light emission control driver 40 is connected to the plurality of light emission control lines E1 to En, generates a light emission control signal in response to a light emission driving control signal ECS of the timing controller 50, and outputs the generated light emission control signal to the light emission control lines E1 to En. The light emission control driver 40 may be configured of a plurality of stage circuits, and controls a light emission period of the pixels PXij by supplying the light emission control signal to the light emission control lines E1 to En.

The timing controller 50 receives the image data DATA, and synchronization signals Hsync and Vsync, a clock signal CLK, and the like for controlling display of the image data DATA. The timing controller 50 performs an image process on the input image data DATA to generate corrected image data DATA' suitable for image display of the pixel unit 10, and outputs the corrected image data DATA' to the data driver 30. In addition, the timing controller 50 may generate the driving control signals SCS, DCS, and ECS for controlling driving of the scan driver 20, the data driver 30, and the light emission control driver 40 based on the synchronization signals Hsync and Vsync and the clock signal CLK. For example, the timing controller 50 may generate and supply the scan driving control signal SCS to the scan driver 20, generate and supply the data driving control signal DCS to the data driver 30, and generate and supply the light emission control signal ECS to the light emission control driver 40.

Figure 2:
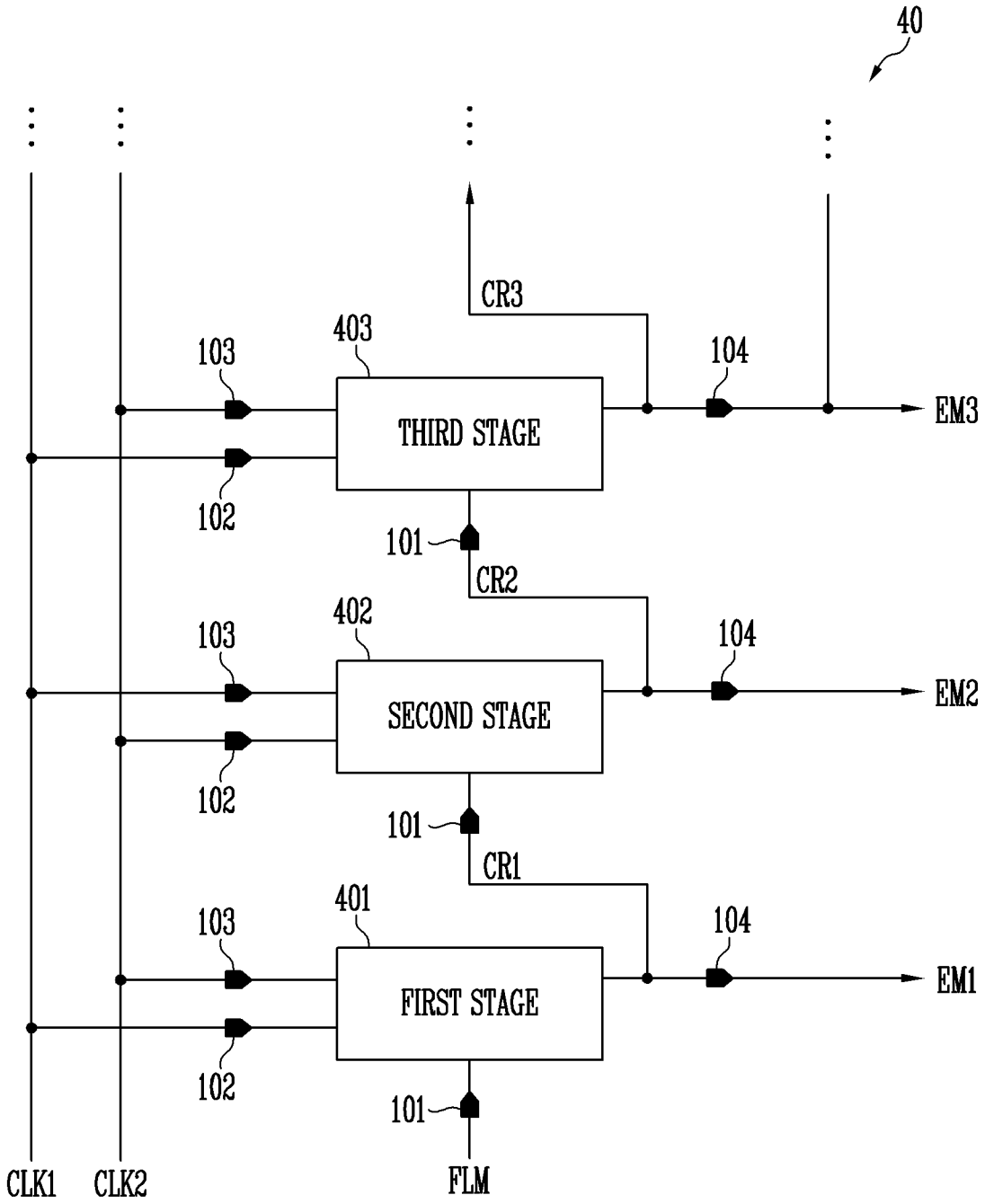
FIG. 2 is a diagram for describing a light emission control driver according to some example embodiments of the disclosure.

FIG. 2 is a diagram illustrating further details of the light emission control driver 40 according to some example embodiments of the disclosure.

Referring to FIGS. 1 and 2 together, the light emission control driver 40 may include a plurality of stages 401, 402, 403, . . . for supplying light emission control signals EM1, EM2, EM3, . . . to the light emission control lines E1-En. The number of stages may vary according to the design of the light emission control driver 40 and the number of light emission control lines E1-En. However, for convenience of description, only three stages 401, 402, and 403 are shown in the drawing.

The stages 401, 402, 403, . . . are driven by a light emission start signal FLM, a first clock signal CLK1, and a second clock signal CLK2, and output the light emission control signals EM1, EM2, EM3, . . . . The light emission start signal FLM, the first clock signal CLK1, and the second clock signal CLK2 may be received through the light emission driving control signal ECS from the timing controller 50. The stages 401, 402, 403, . . . may be part of the same circuit or different circuits.

Each of the stages 401, 402, 403, . . . may include a first input terminal 101, a second input terminal 102, a third input terminal 103, and an output terminal 104.

The first input terminal 101 may receive carry signals CR1, CR2, . . . of a previous stage, or the light emission start signal FLM. For example, the first stage 401 may receive the light emission start signal FLM through the first input terminal 101, and the remaining stages may receive the carry signals CR1, CR2, CR3, . . . of the previous stage through the first input terminal 101. The carry signals CR1, CR2, CR3, . . . may include the light emission control signals EM1, EM2, EM3, . . . of the previous stage.

The second input terminal 102 and the third input terminal 103 may receive the first clock signal CLK1 and the second clock signal CLK2, respectively.

The output terminal 104 may be connected to one of the light emission control lines E1, E2, . . . , and En, and the light emission control signals EM1, EM2, EM3, . . . may be output.

The first clock signal CLK1 or the second clock signal CLK2 may be a square wave signal that repeats a logic high level and a logic low level. Periods of the first clock signal CLK1 and the second clock signal CLK2 may be the same. For example, the period may be two horizontal periods 2H. The first clock signal CLK1 and the second clock signal CLK2 may be signals having the same waveform. The first clock signal CLK1 and the second clock signal CLK2 may be set to have a phase difference of a half period or more and gate-on voltage periods of the first clock signal CLK1 and the second clock signal CLK2 do not overlap with each other. For example, while the first clock signal CLK1 is a logic high level, the second clock signal CLK2 may be a logic low level, and while the first clock signal CLK1 is a logic low level, the second clock signal CLK2 may be a logic high level. However, this is merely an example, and a waveform relationship between the first clock signal CLK1 and the second clock signal CLK2 is not necessarily limited thereto.

Referring to FIG. 2, the first stage 401 may output the first light emission control signal EM1 to pixels connected to the light emission control line (one of E1 to En) in response to the light emission start signal FLM and the first and second clock signals CLK1 and CLK2 and may output the first carry signal CR1 to the second stage 402.

The second stage 402 may output the second light emission control signal EM2 to the pixels connected to the light emission control line (one of E1 to En) in response to the first clock signal CLK1, the second clock signal CLK2, and the first carry signal CR1, and may output the second carry signal CR2 to the third stage 403.

The third stage 403 may output the third light emission control signal EM3 to the pixels connected to the light emission control line (one of E1 to En) in response to the first clock signal CLK1, the second clock signal CLK2, and the second carry signal CR2, and may output the third carry signal CR3 to a fourth stage.

Meanwhile, in FIG. 2, each stage directly receives the first clock signal CLK1 and the second clock signal CLK through the second input terminal 102 and the third input terminal 103, but embodiments according to the present disclosure are not necessarily limited thereto. According to some example embodiments, the first stage 401 may directly receive the first clock signal CLK1 and the second clock signal CLK2, but the remaining stages 402, 403, . . . may receive any one of the first clock signal CLK1 and the second clock signal CLK2 from the previous stage. As a more detailed example, odd-numbered stages 403, . . . excluding the first stage 401 may receive the first clock signal CLK1 from the previous stage and may directly receive the second clock signal CLK2. Even-numbered stage 402, . . . may directly receive the first clock signal CLK1 and may receive the second clock signal CLK2 from the previous stage. As described above, according to some example embodiments, the carry signals may include at least one of the first clock signal CLK1 or the second clock signal CLK2.

In addition, the first clock signal CLK1 and the second clock signal CLK2 may be alternately input when the first clock signal CLK1 and the second clock signal CLK2 are input to each stage.

For example, as shown in FIG. 2, the odd-numbered stages 401, 403, . . . may receive the first clock signal CLK1 through the second input terminal 102 and may receive the second clock signal CLK2 through the third input terminal 103. The even-numbered stages 402, . . . may receive the second clock signal CLK2 through the second input terminal 102 and may receive the first clock signal CLK1 through the third input terminal 103.

Figure 3:
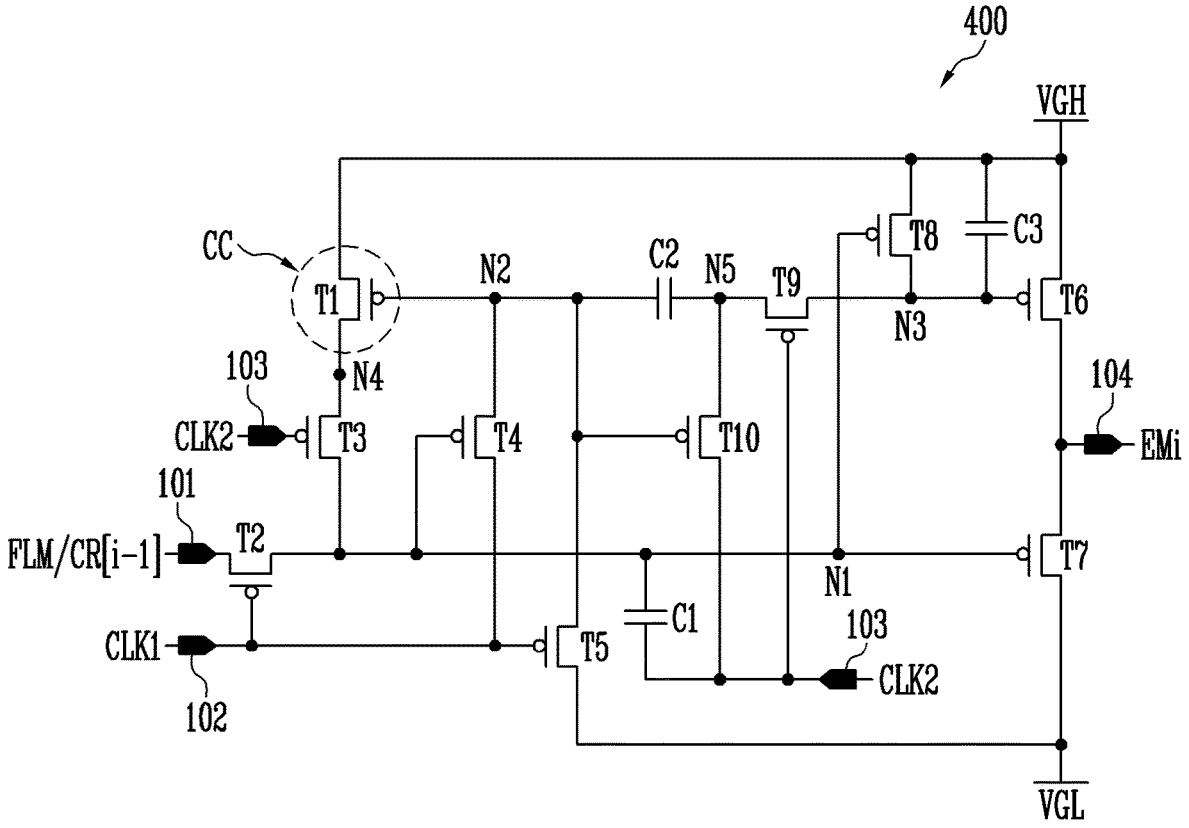
FIG. 3 is an example circuit diagram illustrating a stage according to FIG. 2.

FIG. 3 is an example circuit diagram illustrating further details of an example stage according to FIG. 2.

Referring to FIG. 3, an example circuit diagram for any i-th stage 400 of the stages 401, 402, 403, . . . shown in FIG. 2 will be described. At this time, as the odd-numbered stages are shown in FIG. 2, the i-th stage 400 may receive one of the light emission start signal FLM and a carry signal CR[i−1] of the previous stage through the first input terminal 101 and may receive the first clock signal CLK1 and the second clock signal CLK2 through the second input terminal 102 and the third input terminal 103, respectively.

However, as described with reference to FIG. 2, it should be interpreted that the second clock signal CLK2 may be input to the second input terminal 102 and the first clock signal CLK1 may be input to the third input terminal 103.

Referring to FIG. 3, the stage 400 may include a plurality of transistors T1 to T10 and a plurality of capacitors C1, C2, and C3. Embodiments according to the present disclosure, and according to some example embodiments, there may be fewer or additional transistors, capacitors, or other electrical circuit components, without departing from the spirit and scope of embodiments according to the present disclosure.

The first transistor T1 may be connected between first power VGH and a fourth node N4, and may include a gate electrode connected to a second node N2. When the first transistor T1 is turned on by a voltage (for example, a low level voltage) applied to the second node N2, a voltage (for example, a high level voltage) according to the first power VGH may be transferred to the fourth node N4.

The second transistor T2 may include a gate electrode connected to the second input terminal 102, and may be connected between the first input terminal 101 to which one of the light emission start signal FLM and the carry signal CR[i−1] of the previous stage is applied and a first node N1. When the second transistor T2 is turned on by the first clock signal CLK1, the first input terminal 101 and the first node N1 may be electrically connected to each other.

The third transistor T3 may include a gate electrode connected to the third input terminal 103, and may be connected between the fourth node N4 and the first node N1.

The fourth transistor T4 may include a gate electrode connected to the first node N1, and may be connected between the second node N2 and the second input terminal 102.

The fifth transistor T5 may include a gate electrode connected to the second input terminal 102, and may be connected between the second node N2 and second power VGL.

The sixth transistor T6 may include a gate electrode connected to a third node N3, and may be connected between the first power VGH and the output terminal 104.

The seventh transistor T7 may include a gate electrode connected to the first node N1, and may be connected between the output terminal 104 and the second power VGL.

The eighth transistor T8 may include a gate electrode connected to the first node N1, and may be connected between the first power VGH and the third node N3.

The ninth transistor T9 may include a gate electrode connected to the third input terminal 103, and may be connected between a fifth node N5 and the third node N3.

The tenth transistor T10 may include a gate electrode connected to the second node N2, and may be connected between the fifth node N5 and the third input terminal 103.

The first capacitor C1 may be connected between the first node N1 and the third input terminal 103.

The second capacitor C2 may be connected between the second node N2 and the fifth node N5.

The third capacitor C3 may be connected between the first power VGH and the third node N3.

The plurality of transistors T1 to T10 shown in FIG. 3 may be P-type transistors. Therefore, a gate on voltage of the plurality of transistors T1 to T10 shown in FIG. 3 may be a low level, and a gate off voltage may be a high level. However, the disclosure is not necessarily limited thereto, it should be interpreted that modification of all or some of the plurality of transistors T1 to T10 shown in FIG. 3 into an n-type transistor is included in an embodiment of the disclosure.

In addition, in the stage 400 according to FIG. 3, the first power VGH may provide a high level voltage (or gate off voltage) for turning off a P-type transistor (or a plurality of transistors T1 to T10), and the second power VGL may provide a low level voltage (or a gate on voltage) for turning on the P-type transistor (or the plurality of transistors T1 to T10).

Meanwhile, the first transistor T1 shown in FIG. 3 may transfer a current according to the first power VGH to the fourth node N4, and the current transferred to the fourth node N4 may be transferred to the first node N1 through the third transistor T3. That is, the first transistor T1 may transfer the current according to the first power VGH to the first node N1. At this time, the first node N1 is connected to the second transistor T2 connected to the first input terminal 101.

Figure 4:
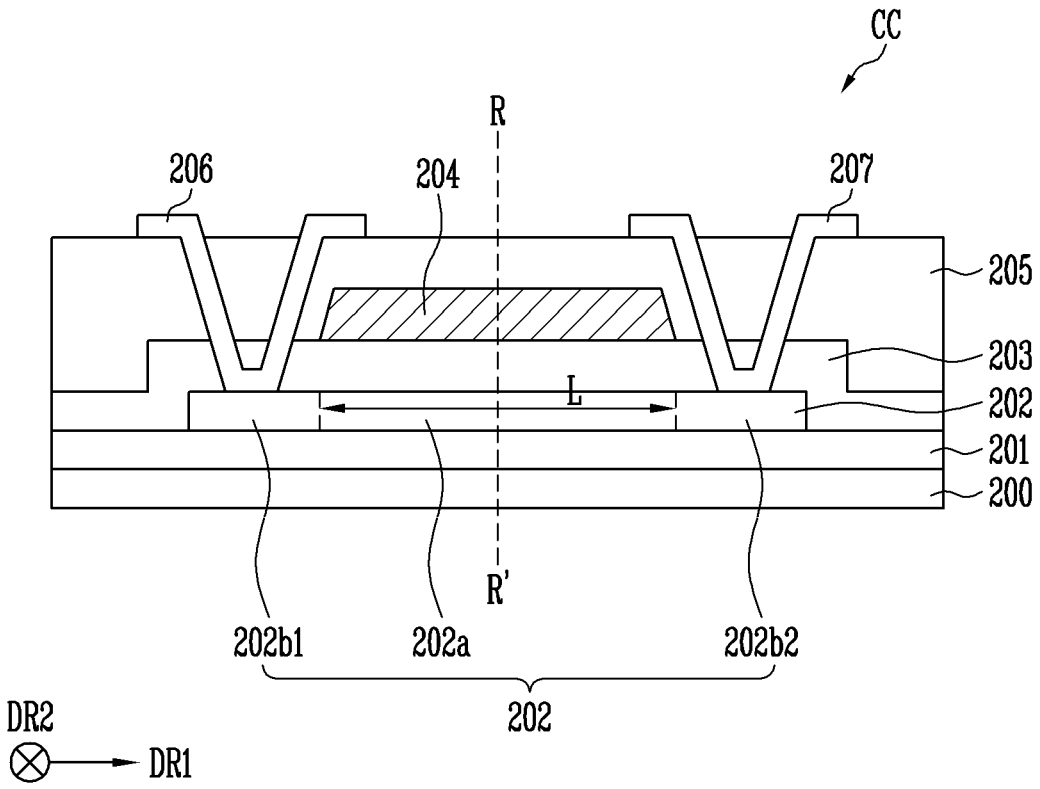
FIG. 4 is a cross-sectional view of a first transistor according to FIG. 3.

FIG. 4 is a cross-sectional view of the first transistor according to FIG. 3.

An example cross-sectional view CC of the first transistor T1 according to FIG. 3 is shown in FIG. 4.

Referring to FIG. 4, the first transistor T1 may include an active layer pattern 202 located on one surface of a base layer 200, and including a channel region 202*a* forming a channel of the first transistor T1 and a first region 202*b*1 and a second region 202*b*2 located on both sides of the channel region 202*a*, a gate electrode 204 spaced apart from the active layer pattern 202 by a first insulating film 203 and overlapping the channel region 202*a* of the active layer pattern 202, and a first electrode 206 and a second electrode 207 spaced apart from the active layer pattern 202 by the first insulating film 203 and a second insulating film 205 and respectively connected to the first region 202*b*1 and the second region 202*b*2 of the active layer pattern 202.

One of the first region 202*b*1 and the second region 202*b*2 may be a source region of the first transistor T1, and the other may be a drain region of the first transistor T1. For example, when the first region 202*b*1 is the source region of the first transistor T1, the second region 202*b*2 may be the drain region of the first transistor T1. In contrast, when the first region 202*b*1 is the drain region of the first transistor T1, the second region 202*b*2 may be the source region of the first transistor T1. This may vary according to a carrier type (for example, N type or P type) of the first transistor T1 and a direction of a current.

Meanwhile, a position of the first electrode 206 and the second electrode 207 in the disclosure is not particularly limited, and this may be variously changed according to some example embodiments. In addition, according to some example embodiments, at least one of the first electrode 206 or the second electrode 207 may be omitted.

For example, when the first transistor T1 is directly connected to another circuit element (for example, at least one other transistor, capacitor, and/or the like) through the first region 202*b*1, the first electrode 206 may be omitted. Similarly, when the first transistor T1 is directly connected to another circuit element through the second region 202*b*2, the second electrode 207 may be omitted.

In addition, according to a point of view, the first region 202*b*1 and/or the second region 202*b*2 may be regarded as the source electrode and/or the drain electrode of the first transistor T1, and the first electrode 206 and/or the second electrode 207 may be regarded as wires connected to one electrode of the first transistor T1 or electrodes of another circuit element.

Each of the channel region 202*a*, the first region 202*b*1, and the second region 202*b*2 may include polycrystalline silicon (Poly-Si, or polysilicon).

At this time, a channel length of the channel region 202*a* according to a first direction DR1 passing through the first region 202 *b*1 and the second region 202*b*2 of the active layer pattern 202 (or perpendicular to the first region 202*b*1 and the second region 202*b*2) may be defined as a channel length L, and a length according to the second direction DR2 perpendicular to the first direction DR1 may be defined as a channel width.

In addition, as shown in FIG. 4, the gate electrode 204 may include a region having the same width as the channel length L (a width of the gate electrode 204 according to the first direction DR1), but embodiments are not necessarily limited thereto.

Meanwhile, when a voltage of a source electrode or a drain electrode of a thin film transistor (TFT) increases, a driving current (a current flowing through the transistor in a transistor turn-on state) of the transistor decreases due to a hot carrier instability (HCl) phenomenon. Taking the first transistor T1 shown in FIG. 4 as an example, when a voltage of the second electrode 207 increases, because an electric field increases in a pinch-off region positioned near the second region 202*b*2 (or the drain region), an electron is accelerated by the electric field and have high speed and high kinetic energy. As described above, the electron having increased mobility may penetrate the first insulating film 203 or accumulate in the first insulating film 203, and may disturb an electrical characteristic of the first transistor T1 to decrease the driving current.

As described above, as shown in FIG. 3, when the HCl phenomenon occurs in at least one (for example, the first transistor T1) of the plurality of transistors T1 to T10 configuring the stage 400 of the light emission control driver 40, a problem such as a flicker phenomenon may occur due to an output waveform decrease of the light emission control signal.

Hereinafter, a structure in which the driving current decrease is improved by preventing or reducing degradation based on the first transistor T1 having a high tendency to cause degradation due to the HCl phenomenon in FIG. 3 will be described, but the disclosure is not necessarily limited to the first transistor T1. For example, the disclosure may be applied to one or more of the plurality of transistors shown in FIG. 3. In addition, the disclosure may be applied to at least one of the transistors configuring the stage of the scan driver 20 shown in FIG. 1.

Figure 5:
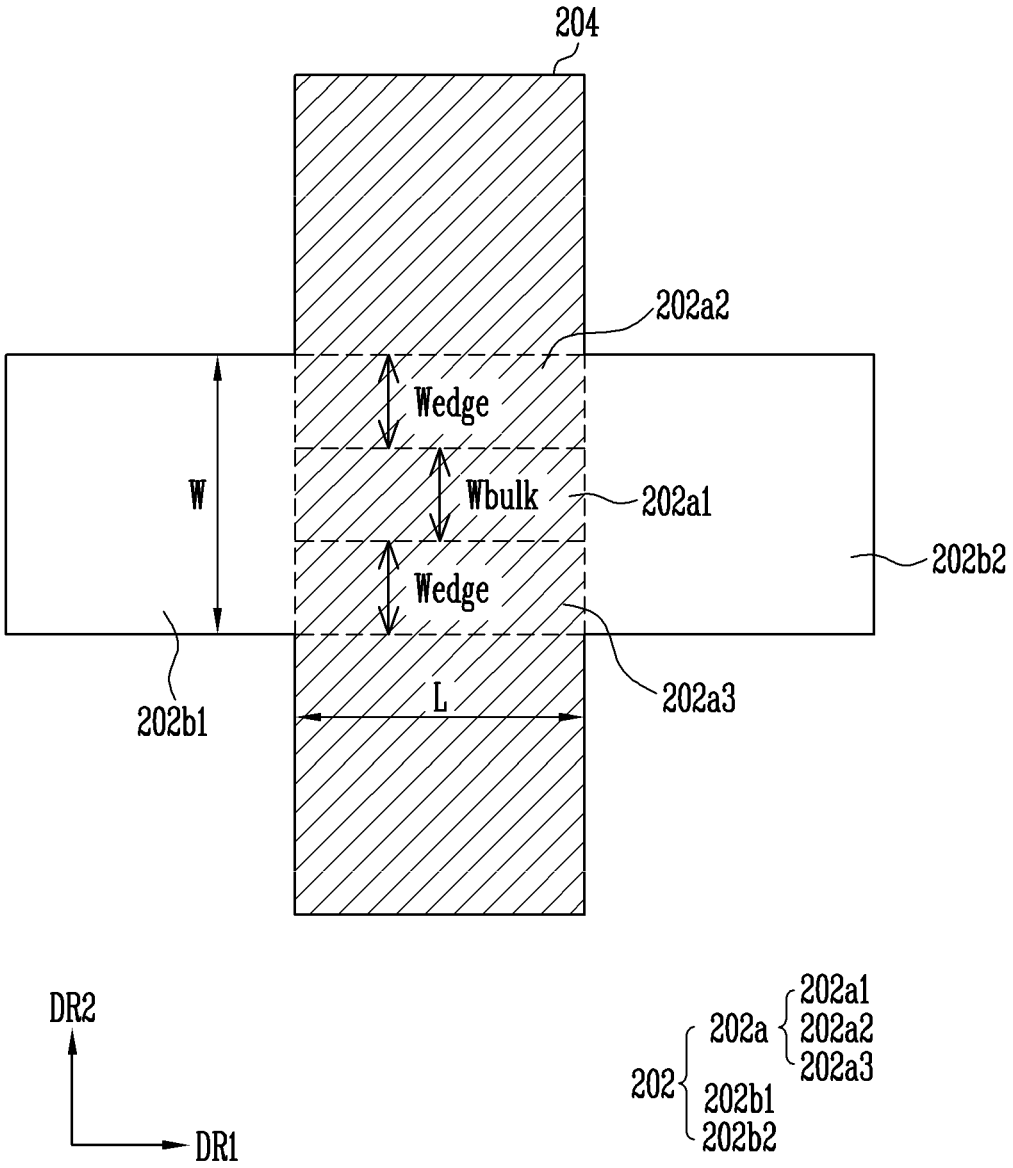
FIG. 5 is a plan view of the first transistor according to FIG. 3.
Figure 6:
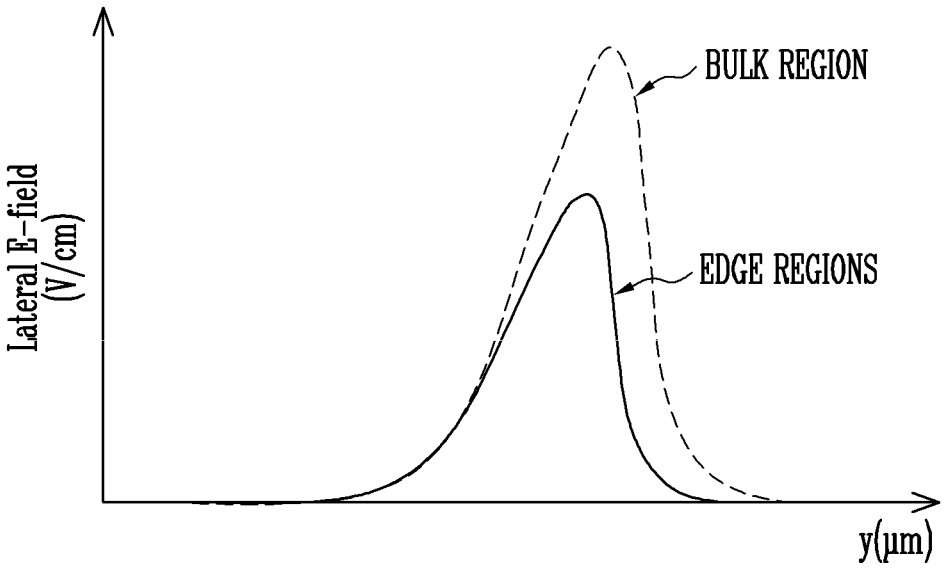
FIG. 6 is a graph obtained by measuring a side surface electric field for regions according to FIG. 5.

FIG. 5 is a plan view of the first transistor according to FIG. 3. FIG. 6 is a graph obtained by measuring a side surface electric field for regions according to FIG. 5.

FIG. 5 is a plan view illustrating the active layer pattern 202 and the gate electrode 204 of the first transistor T1 of FIG. 3.

The channel region 202*a* of the active layer pattern 202 shown in FIG. 5 may include regions 202*a*1, 202*a*2, and 202*a*3 overlapping the gate electrode 204.

Referring to FIG. 5, the channel region 202*a* of the active layer pattern 202 includes a first edge region 202*a*2 and a second edge region 202*a*3 positioned on both side surfaces based on a channel width W, and a bulk region 202*a*1 positioned between the first edge region 202*a*2 and the second edge region 202*a*3. At this time, the channel width W may be equal to a sum of a width Wedge1 of the first edge region 202*a*2, a width Wedge2 of the second edge region 202*a*3, and a width Wbulk of the bulk region 202*a*1.

In the first edge region 202*a*2 or the second edge region 202*a*3 shown in FIG. 5, because a vertical electric field is concentrated, the side surface electric field (lateral electric field, or lateral E-field) decreases under the same voltage condition.

Referring to FIG. 6, the lateral E-field according to the first edge region 202*a*2 or the second edge region 202*a*3 may be lower than that of the bulk region 202*a*1. Therefore, the HCl phenomenon may relatively decrease in the first edge region 202*a*2 and the second edge region 202*a*3 positioned at the both side surfaces of the channel region 202*a* than the bulk region 202*a*3.

At this time, when the channel width W is narrowed, the area occupied by the edge regions 202*a*2 and 202*a*3 in the channel region 202*a* increases, and the area occupied by the bulk region 202*a*1 is decreased. Therefore, the narrower the channel width W is, the more effective the driving current may be prevented from being degraded according to the HCl phenomenon.

Hereinafter, based on this point, a structure that may prevent or reduce the HCl phenomenon by narrowing the channel width W of the channel region 202*a* will be described.

Figure 7:
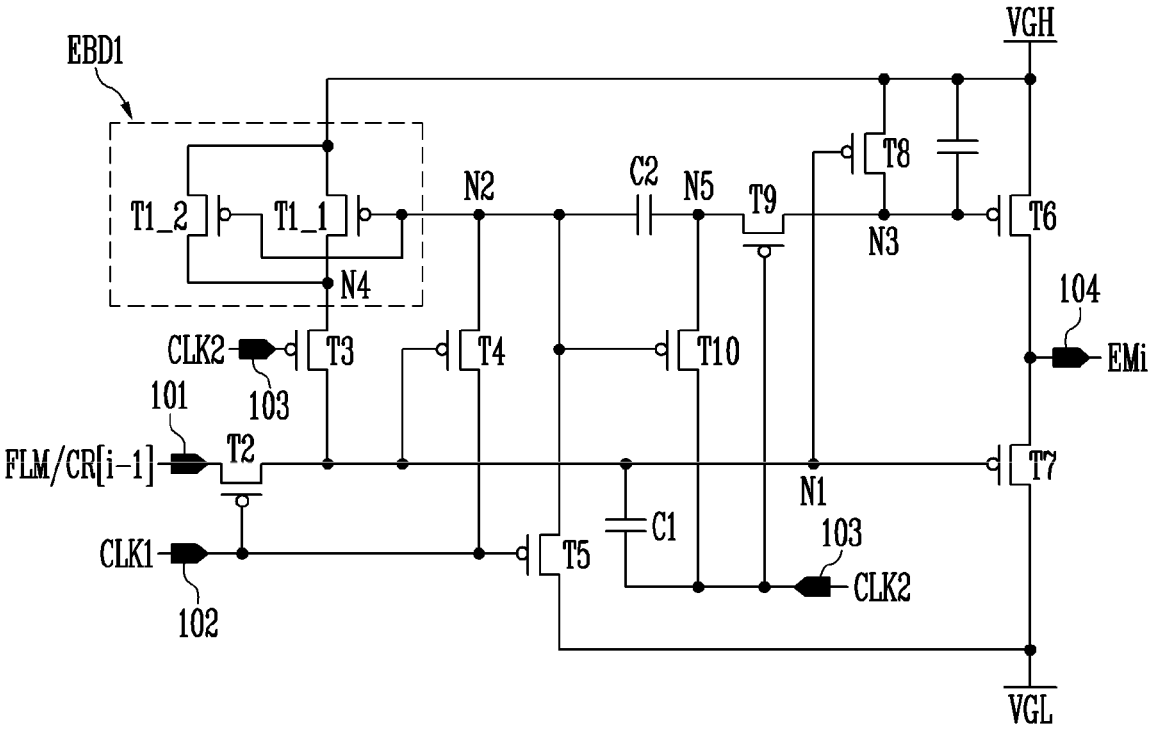
FIG. 7 is a circuit diagram to which a first embodiment of the first transistor of FIG. 3 is applied.
Figure 8:
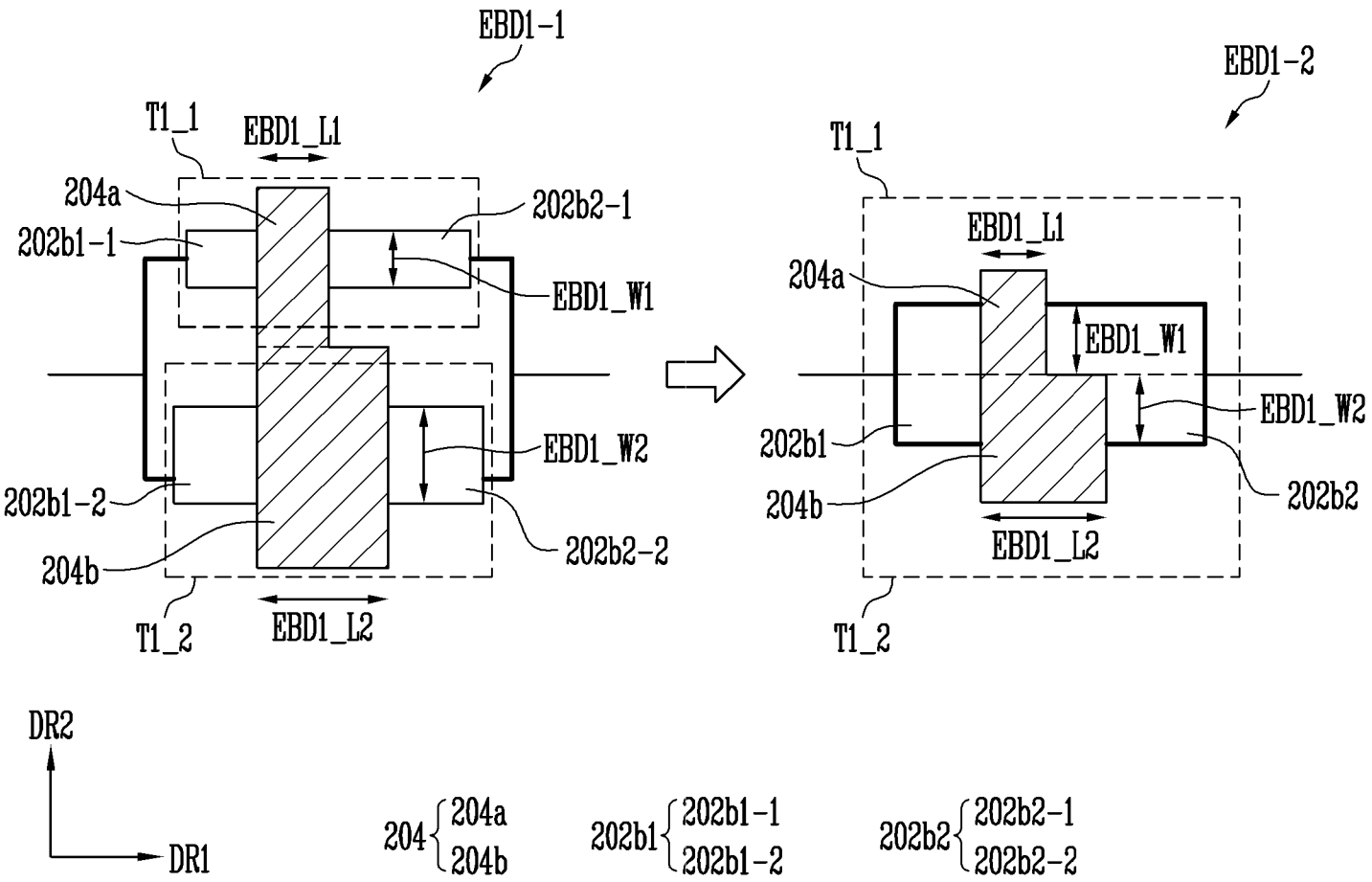
FIG. 8 is a plan view of the first embodiment of the first transistor according to FIG. 7.

FIG. 7 is a circuit diagram to which a first embodiment of the first transistor of FIG. 3 is applied. FIG. 8 is a plan view of the first embodiment of the first transistor according to FIG. 7.

Referring to FIG. 7, the first transistor T1 may include a first sub transistor T1_1 and a second sub transistor T1_2 connected in parallel with each other. Each of the first sub transistor T1_1 and the second sub transistor T1_2 may include a channel region, and a first region and a second region positioned on both sides of the channel region, respectively.

Here, the first sub transistor T1_1 and the second sub transistor T1_2 may be connected between the first power VGH and the fourth node N4. Each of the first sub transistor T1_1 and the second sub transistor T1_2 may include a gate electrode commonly connected to the second node N2.

FIG. 8 is a plan view of the first transistor T1 including the first sub transistor T1_1 and the second sub transistor T1_2 connected in parallel with each other.

Referring to a reference numeral EBD1-1 of FIG. 8, a channel width EBD1_W1 of the first sub transistor T1_1 may be narrower than a channel width EBD1_W2 of the second sub transistor T1_2. The first sub transistor T1_1 having such a narrow channel width may have a strong characteristic because the first sub transistor T1_1 is less affected by the HCl phenomenon.

In addition, a channel length EBD1_L1 of the first sub transistor T1_1 may be shorter than a channel length EBD1_L2 of the second sub transistor T1_2.

Meanwhile, the first sub transistor T1_1 and the second sub transistor T1_2 may share one gate electrode 204 as shown by reference numerals EBD1-1 or EBD1-2 of FIG. 8. At this time, a width of the gate electrode 204 overlapping the channel region of the first sub transistor T1_1 may be narrower than a width of the gate electrode 204 overlapping the channel region of the second sub transistor T1_2. For example, the width of the gate electrode 204 overlapping the channel region of the first sub transistor T1_1 may be less than 4 μm or may be 1 μm.

As shown by the reference numeral EBD1-1, the gate electrode 204 may include a first gate region 204*a* having a first width (not shown since the first width is equal to EBD_L1) corresponding to the channel length EBD_L1 of first sub-transistor T1_1, and a second gate region 204*b* having a second width (not shown since the second width is equal to EBD_L2) corresponding to the channel length EBD_L2 of the second sub transistor T1_2 and longer than the first width. At this time, the second gate region 204*b* may be connected to the first gate region 204*a* along the second direction DR2.

In addition, at least one of the first region 202*b*1 or the second region 202*b*2 of the first transistor T1 may be divided into a region of the first sub transistor T1_1 and a region of the second sub transistor T1_2 spaced apart from the first sub transistor T1_1. For example, as shown by the reference numeral EBD1-1, a first region 202*b*1-1 of the first sub transistor T1_1 and a first region 202*b*1-2 of the second sub transistor T1-2 may be spaced apart from each other and may be separated from each other, and a second region 202*b*2-1 of the first sub transistor T1_1 and a second region 202*b*2-2 of the second sub transistor T1_2 may be spaced apart from each other and may be separated from each other. At this time, the first region 202*b*1-1 of the first sub transistor T1-1 and the first region 202*b*1-2 of the second sub transistor T1-2 may be included in the first region 202*b*1 of the first transistor T1. In addition, the second region 202*b*2-1 of the first sub transistor T1_1 and the second region 202*b*2-2 of the second sub transistor T1_2 may be included in the second region 202*b*2 of the first transistor T1.

Meanwhile, as shown by the reference numeral EBD1-2, the first sub transistor T1_1 and the second sub transistor T1_2 may share a single first region 202*b*1 of the first transistor T1 and may share a single second region 202*b*2 of the first transistor T1. For example, the first region 202*b*1-1 of the first sub transistor T1_1 may be coupled to the first region 202*b*1-2 of the second sub transistor T1_2 to form the first region 202*b*1 (for example, the source region or the drain region) of the first transistor T1, and the second region 202*b*2-1 of the first sub transistor T1_1 may be coupled to the second region 202*b*2-2 of the second sub transistor T1_2 to form the second region 202*b*2 (for example, the drain region or the source region) of the first transistor T1.

Figure 9:
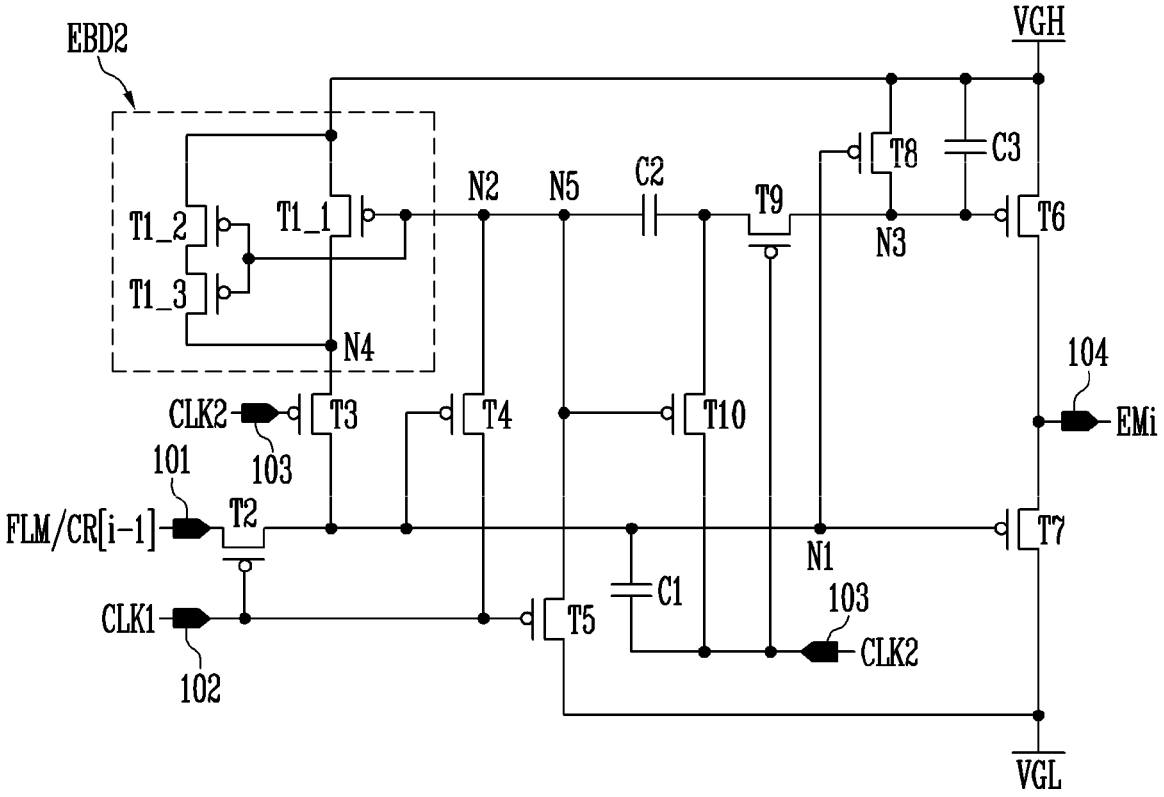
FIG. 9 is a circuit diagram to which a second embodiment of the first transistor of FIG. 3 is applied.
Figure 10:
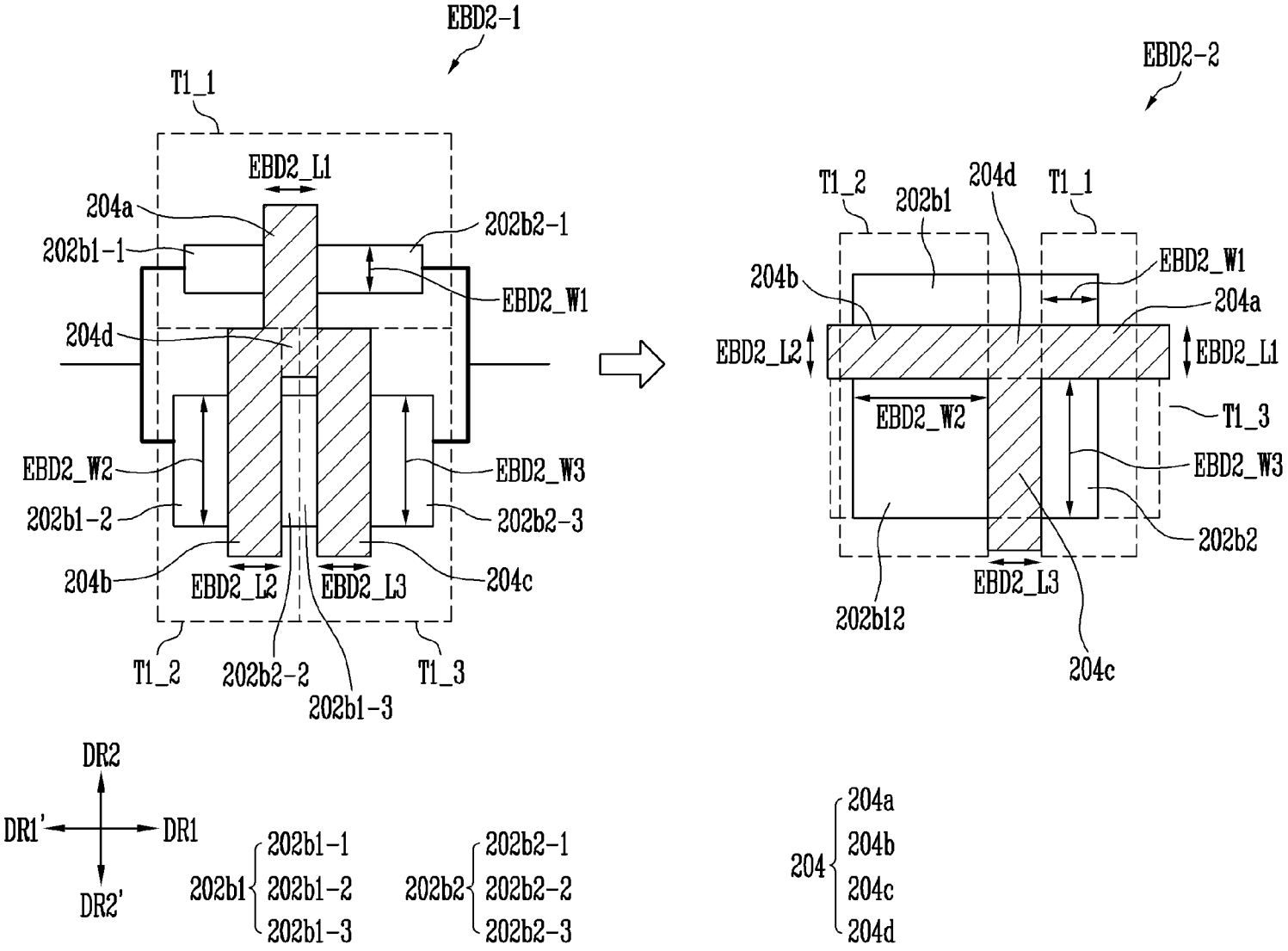
FIG. 10 is a plan view of the second embodiment of the first transistor according to FIG. 9.

FIG. 9 is a circuit diagram to which a second embodiment of the first transistor of FIG. 3 is applied. FIG. 10 is a plan view of the second embodiment of the first transistor according to FIG. 9.

Referring to FIG. 9, the first transistor T1 may include a first sub transistor, and a second sub transistor T1_2 and a third sub transistor T1_3 having a common gate electrode and connected in series with each other. Each of the first sub transistor T1_1, the second sub transistor T1_2, and the third sub transistor T1_3 may include a channel region, and a first region and a second region positioned on both sides of the channel region, respectively.

The first sub transistor T1_1 may be connected between the first power VGH and the fourth node N4, and may include a gate electrode connected to the second node N2.

The second sub transistor T1_2 may be connected between the first power VGH and one end of the third sub transistor T1_3, and may include a gate electrode connected to the second node N2.

The third sub transistor T1_3 may be connected between one end of the second sub transistor T1_2 and the fourth node N4, and may include a gate electrode connected to the second node N2.

FIG. 10 is a plan view of the first transistor T1 including the first sub transistor T1_1, the second sub transistor T1_2, and the third sub transistor T1_3.

Referring to a reference numeral EBD2-1 of FIG. 10, a channel width EBD2_W1 of the first sub transistor T1_1 may be narrower than a channel width EBD2_W2 of the second sub transistor T1_2 or a channel width EBD2_W3 of the third sub transistor T1_3. The first sub transistor T1_1 having such a narrow channel width EBD2_W1 may have a strong characteristic because the first sub transistor T1_1 is less affected by the HCl phenomenon.

In addition, the channel width EBD2_W2 of the second sub transistor T1_2 may be the same as the channel width EBD2_W3 of the third sub transistor T1_3.

In addition, the channel lengths EBD2_L1, EBD2_L2, and EBD2_L3 of the first sub transistor T1_1, the second sub transistor T1_2, and the third sub transistor T1_3 may be less than a channel length of at least one of the remaining transistors included in the stage. For example, the channel lengths EBD2_L1, EBD2_L2, and EBD2_L3 of the first sub transistor T1_1, the second sub transistor T1_2, and the third sub transistor T1_3 may be less than 4 μm or may be 1 μm.

In addition, the first sub transistor T1_1, the second sub transistor T1_2, and the third sub transistor T1_3 may share the gate electrode 204 with each other. For example, as shown by a reference numeral EBD2-1, the gate electrode 204 may include a first gate region 204*a* having a first width (not shown since the first width is equal to EBD2_L1) corresponding to the channel length EBD2_L1 of first sub-transistor T1_1, a second gate region 204*b* having a second width (not shown since the second width is equal to EBD2_L2) corresponding to the channel length EBD2_L2 of the second sub transistor T1_2, and a third gate region 204*c* having a third width (not shown since the third width is equal to EBD2_L3) corresponding to the channel length EBD2_L3 of third sub transistor T1_3. At this time, the first width and the second width may be the same.

In addition, the gate electrode 204 may further include a fourth gate region 204*d* connecting the first gate region 204*a*, the second gate region 204*b*, and the third gate region 204*c* to each other.

The first gate region 204*a* may overlap the channel region of the first sub transistor T1_1, the second gate region 204*b* may overlap the channel region of the second sub transistor T1_2, and the third gate region 204*c* may overlap the channel region of the third sub transistor T1_3.

In addition, the second region 202*b*2-2 of the second sub transistor T1_2 and the first region 202*b*1-3 of the third sub transistor T1_3 may be adjacent to each other.

Referring to a reference numeral EBD2-2 of FIG. 10, the first region 202*b*1-1 of the first sub transistor T1_1 may be coupled to the first region 202*b*1-2 of the second sub transistor T1_2 to form the first region 202*b*1 of the first transistor T1, and the second region 202*b*2-1 of the first sub transistor T1_1 may be coupled to the second region 202*b*2-3 of the third sub transistor T1_3 to form the second region 202*b*2 of the first transistor T1. In addition, the second region (not shown) of the first sub transistor T1_1 and the first region of the third sub transistor T1_3 may be adjacent to each other, and a region 202*b*12 where the second region of the first sub transistor T1_1 and the first region of the third sub transistor T1_3 are adjacent to each other may be included in the channel region 202*a* of the first transistor T1.

In addition, as shown by the reference numeral EBD2-2, the gate electrode 204 may have a shape of an uppercase alphabetic letter CT'. For example, the first gate region 204*a*, the second gate region 204*b*, and the fourth gate region 204*d* may be connected to each other to have a single width (first width or second width), and the third gate region 204*c* may be connected to the fourth gate region 204*d* in a direction perpendicular to the first gate region 204*a* or the second gate region 204*b*. For example, the first gate region 204*a* may be connected to the fourth gate region 204*d* in the first direction DR1, the second gate region 204*b* may be connected to the fourth gate region 204*d* in a direction DR1' opposite to the first direction DR1, and the third gate region 204*c* may be connected to the fourth gate region 204*d* in a direction DR2' opposite to the second direction DR2.

Figure 11:
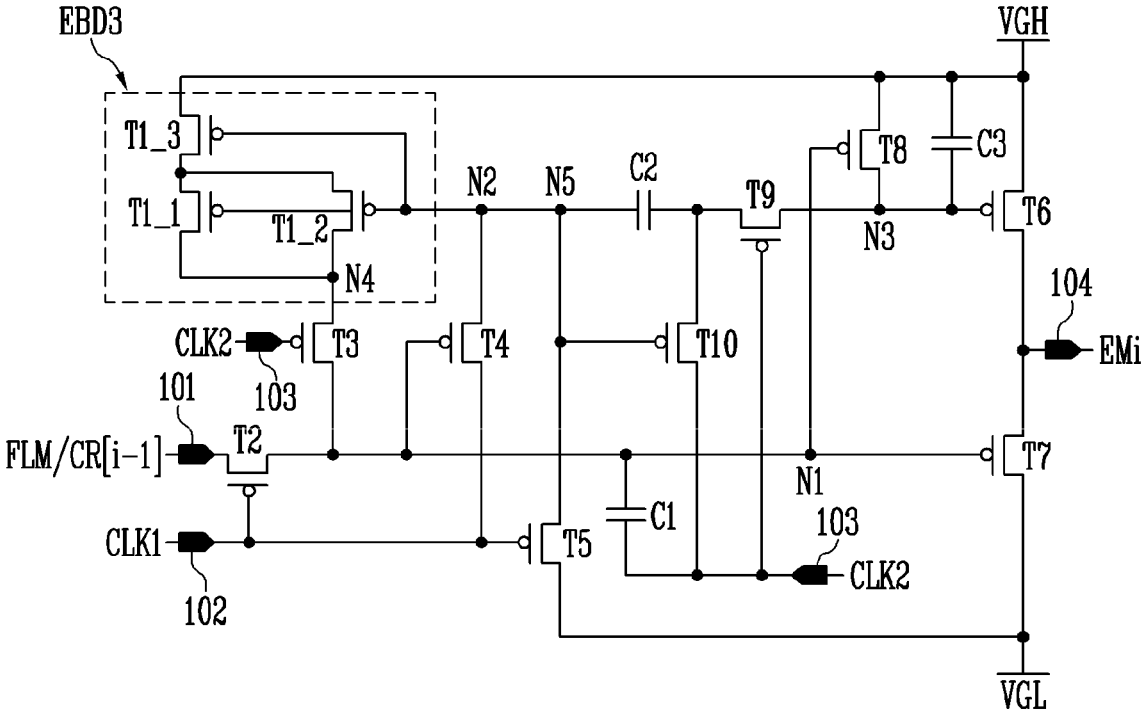
FIG. 11 is a circuit diagram to which a third embodiment of the first transistor of FIG. 3 is applied.
Figure 12:
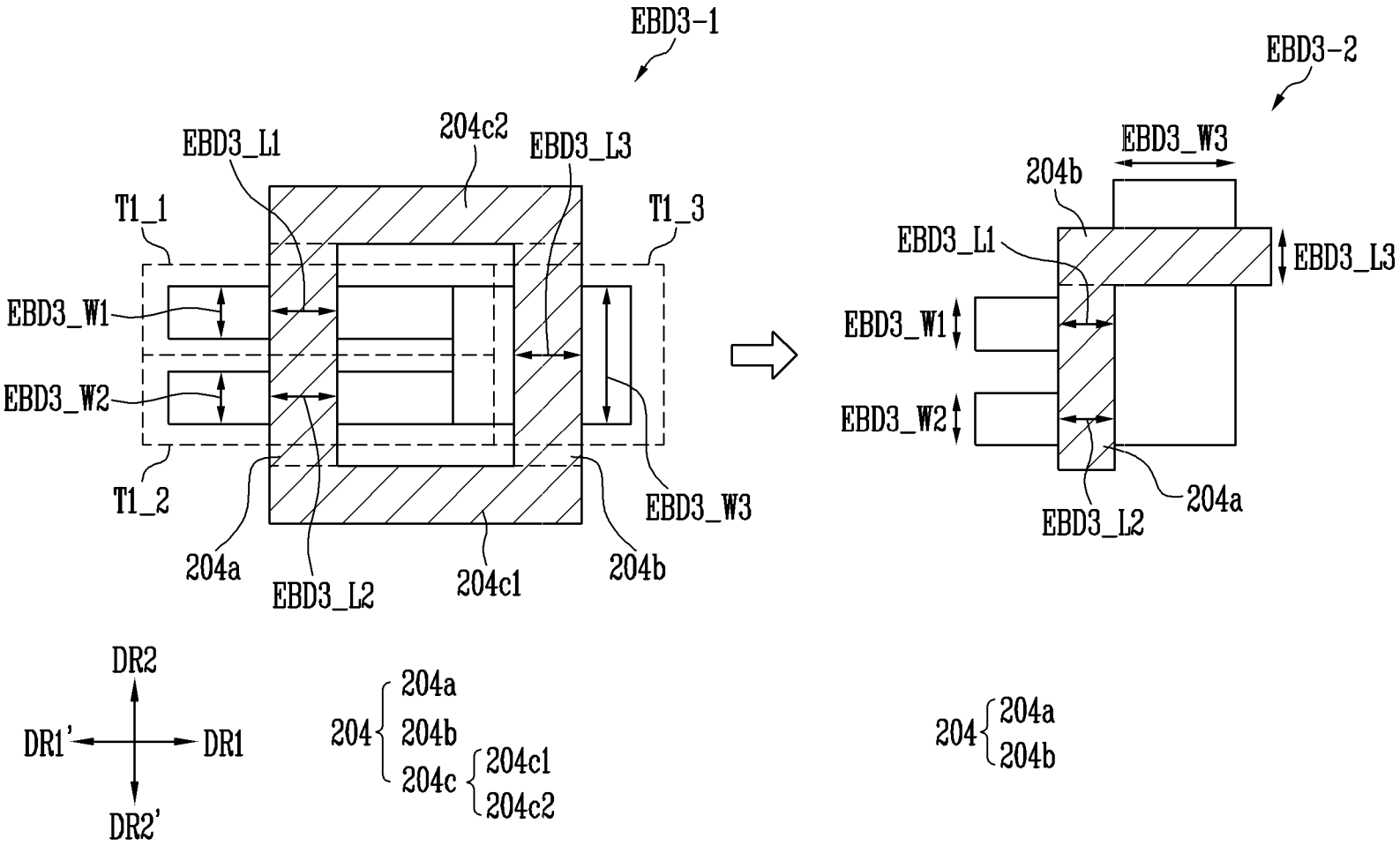
FIG. 12 is a plan view of the third embodiment of the first transistor according to FIG. 11.

FIG. 11 is a circuit diagram to which a third embodiment of the first transistor of FIG. 3 is applied. FIG. 12 is a plan view of the third embodiment of the first transistor according to FIG. 11.

Referring to FIG. 11, the first transistor T1 may include a first sub transistor T1_1 and a second sub transistor T1_2 connected in parallel with each other, and a third sub transistor T1_3 connected in series with the first sub transistor T1_1 and the second sub transistor T1_2. Each of the first sub transistor T1_1, the second sub transistor T1_2, and the third sub transistor T1_3 may include a channel region, and a first region and a second region positioned on both sides of the channel region, respectively.

The first sub transistor T1_1 may be connected between the fourth node N4 and one end of the third sub transistor T1_3, and may include a gate electrode connected to the second node N2.

The second sub transistor T1_2 may be connected between the fourth node N4 and one end of the third sub transistor T1_3, and may include a gate electrode connected to the second node N2.

The third sub transistor T1_3 may be connected between the first power VGH and the first sub transistor T1_1 and one end of the second sub transistor T1_2, and may include a gate electrode connected to the second node N2.

FIG. 12 is a plan view of the first transistor T1 including the first sub transistor T1_1, the second sub transistor T1_2, and the third sub transistor T1_3.

Referring to a reference numeral EBD3-1 of FIG. 12, a channel width EBD3_W1 of the first sub transistor T1_1 may be narrower than a channel width EBD3_W3 of the third sub transistor T1_3. A channel width EBD3_W2 of the second sub transistor T1_2 may be narrower than the channel width EBD3_W3 of the third sub transistor T1_3. Therefore, the first sub transistor T1_1 and the second sub transistor T1_2 having the narrow channel widths EBD3_W1 and EBD2_W2 may have a strong characteristic because the first sub transistor T1_1 and the second sub transistor T1_2 are less affected by the HCl phenomenon. In addition, the channel width EBD2_W2 of the second sub transistor T1_2 may be the same as the channel width EBD2_W3 of the first sub transistor T1_1.

In addition, the channel lengths EBD2_L1, EBD2_L2, and EBD2_L3 of the first sub transistor T1_1, the second sub transistor T1_2, and the third sub transistor T1_3 may be less than channel lengths of the remaining transistors. For example, the channel lengths EBD2_L1, EBD2_L2, and EBD2_L3 of the first sub transistor T1_1, the second sub transistor T1_2, and the third sub transistor T1_3 may be less than 4 μm or may be 1 μm.

In addition, the first sub transistor T1_1, the second sub transistor T1_2, and the third sub transistor T1_3 may share the gate electrode 204 with each other. For example, as shown by the reference numeral EBD3-1, the gate electrode 204 may include a first gate region 204*a* having a first width (that may be equal to EBD3_L1 or EBD3_L3) corresponding to the channel length EBD3_L1 of first sub-transistor T1-1 and the channel length EBD3_L2 of the second sub transistor T1-2, and a second gate region 204*b* having a second width (that may be equal to EBD3_L3) corresponding to the channel length EBD3_L3 of the third sub transistor T1_3.

In addition, the first gate region 204*a* may overlap the channel region of the first sub transistor T1_1 and the channel region of the second sub transistor T1_2. The second gate region 204*b* may overlap the channel region of the third sub transistor T1_3.

Referring to a reference numeral EBD3-1 of FIG. 12, the gate electrode 204 may further include a third gate region 204*c* connecting the first gate region 204*a* and the second gate region 204*b* to each other. The third gate region 204*c* may include a region 204*c*1 connecting one end of the first gate region 204*a* and the second gate region 204*b* to each other, and region 204*c*2 connecting the other end of the first gate region 204*a* and the second gate region 204*b* to each other.

Meanwhile, referring to a reference numeral EBD3-2 of FIG. 12, the first gate region 204*a* and the second gate region 204*b* may be directly connected to each other without the third gate region 204*c*. For example, the first gate region 204*a* and the second gate region 204*b* may be connected to each other to have an angle (or 90 degrees) between 75 degrees and 105 degrees. For example, the first gate region 204*a* and the second gate region 204*b* may be connected to each other so that a side surface corresponding to a first width (equal to EBD3_L1 or EBD3_L2 of the drawing) of the first gate region 204*a* and a side surface corresponding to a second width (equal to EBD3_L3 of the drawing) of the second gate region 204*b* have the angle (or 90 degrees) between 75 degrees and 105 degrees. According to some example embodiments, the first gate region 204*a* may have the first width according to the first direction DR1, and the second gate region 204*b* may have the second width according to the second direction DR2 perpendicular to the first direction DR1.

Figure 13:
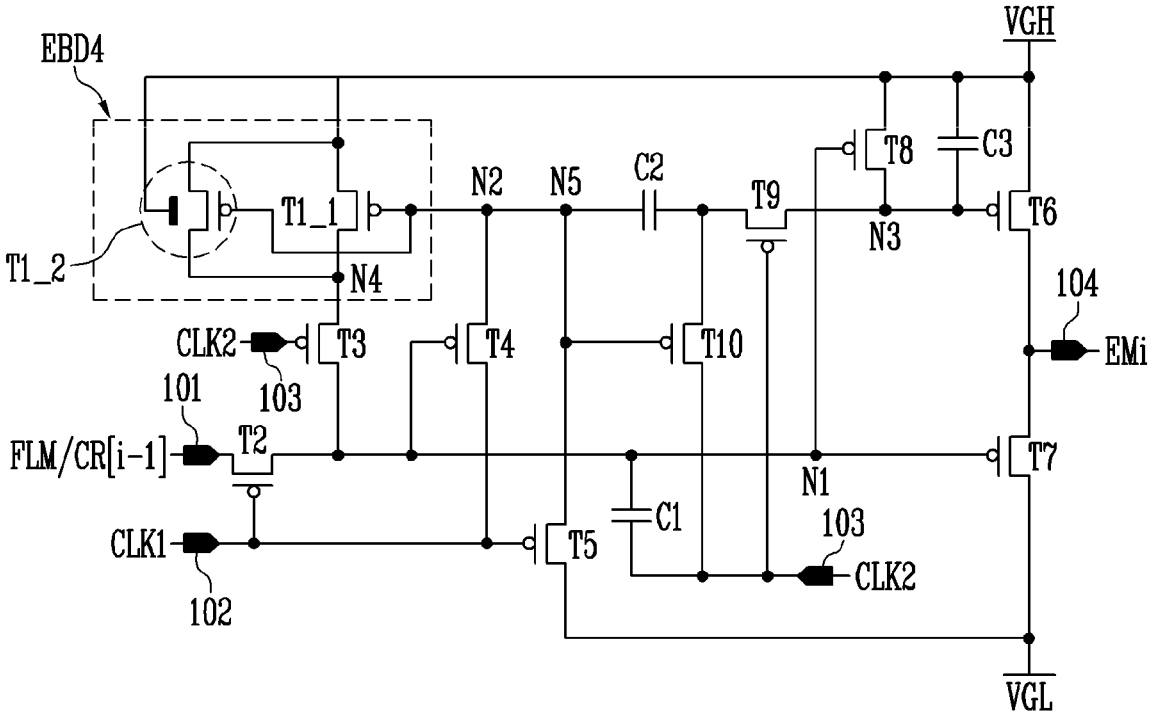
FIG. 13 is a circuit diagram to which a fourth embodiment of the first transistor of FIG. 3 is applied.
Figure 14:
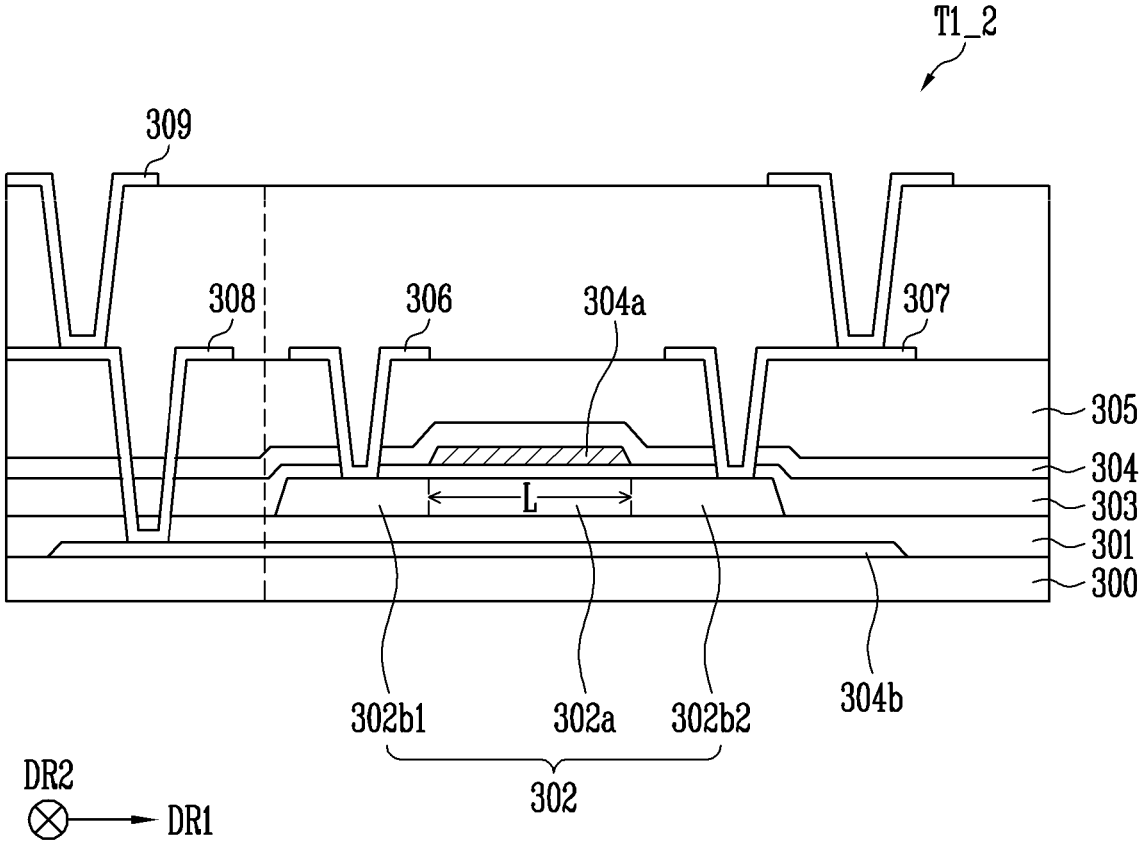
FIG. 14 is a plan view of the fourth embodiment of the first transistor according to FIG. 13.

FIG. 13 is a circuit diagram to which a fourth embodiment of the first transistor of FIG. 3 is applied. FIG. 14 is a plan view of the fourth embodiment of the first transistor according to FIG. 13.

Referring to FIG. 13, the first transistor T1 may include a first sub transistor T1_1 and a second sub transistor T1_2 having a double gate electrode. Each of the first sub transistor T1_1 and the second sub transistor T1_2 may include a channel region, and a first region and a second region positioned on both sides of the channel region, respectively.

The first sub transistor T1_1 may be connected between the first power VGH and the fourth node N4, and may include a gate electrode connected to the second node N2.

The second sub transistor T1_2 may be connected between the first power VGH and the fourth node N4, and may include a first gate electrode 304*b* connected to first power VGH and a second gate electrode 304*a* connected to the second node N2.

A channel length of the first sub transistor T1_1 may be relatively shorter than that of the remaining transistors included in at least one of the stages of the scan driver 20 or the light emission control driver 40. In addition, a channel width of the first sub transistor T1_1 may be relatively narrower than that of the remaining transistors included in at least one of the stages of the scan driver 20 or the light emission control driver 40. For example, the channel length and the channel width of the first sub transistor T1_1 may be less than 4 μm. For example, the channel length and the channel width of the first sub transistor T1_1 may be 1 μm. Therefore, the first sub transistor T1_1 may have a relatively strong characteristic because the first sub transistor T1_1 is relatively less affected by the HCl phenomenon.

Referring to FIG. 14, the second sub transistor T1_2 having the double gate electrode according to FIG. 13 may include a bottom gate electrode 304*b* located on one surface of a base layer 300, an active layer pattern 302 including a channel region 302*a* spaced apart from the first gate electrode 304*b* with the first insulating film 301 interposed therebetween to form a channel of the second sub transistor T1_2, and a first region 302*b*1 and a second region 302*b*2 located on both sides of the channel region 302*a*, a top gate electrode 304*a* spaced apart from the active layer pattern 302 and overlapping the channel region 302*a* of the active layer pattern 302 with a second insulating film 303 interposed therebetween, and a first electrode 306 and a second electrode 307 spaced apart from the active layer pattern 202 and connected to the first region 202*b*1 and the second region 202*b*2 of the active layer pattern 202 with the second insulating film 303, a third insulating film 304, and a fourth insulating film 305 interposed therebetween.

At this time, the top gate electrode 304*a* may be included in the gate electrode 204 of FIG. 4, and the first insulating film 301 may be included in the first insulating film 203 of FIG. 4. In addition, the base layer 300 may be the base layer 200 according to FIG. 4, and the active layer pattern 302 may be included in the active layer pattern 202 according to FIG. 4.

One of the first region 302*b*1 and the second region 302*b*2 may be a source region of the second sub transistor T1_2, and the other may be a drain region of the second sub transistor T1_2. For example, when the first region 302*b*1 is the source region of the second sub transistor T1_2, the second region 302*b*2 may be the drain region of the second sub transistor T1_2. In contrast, when the first region 302*b*1 is the drain region of the second sub transistor T1_2, the second region 302*b*2 may be the source region of the second sub transistor T1_2. This may vary according to a carrier type (for example, N type or P type) and a direction of a current of the second sub transistor T1_2.

The first gate electrode 304*b* may be electrically connected to an electrode 309 connected to a wire of the first power VGH. At this time, the first gate electrode 304*b* may be electrically connected to the electrode 309 through one or more other electrodes 308.

Meanwhile, a channel length L of the second sub transistor T1_2 may be less than a channel length of at least one of the remaining transistors included in at least one of the stages of the scan driver 20 or the light emission control driver 40. For example, the channel length L of the second sub transistor T1_2 may be less than 4 μm. For example, the channel length of the second sub transistor T1_2 may be 1 μm.

In addition, a channel width of the second sub transistor T1_2 is relatively greater than that of at least one of the remaining transistors included in at least one of the stages of the scan driver 20 or the light emission control driver 40. For example, the channel width of the second sub transistor T1_2 may be greater than 4 μm.

In FIG. 14, the channel length L may be a length of the channel region 302*a* according to the first direction DR1, and the channel width may be a length of the channel region 302*a* according to the second direction DR2 perpendicular to the first direction DR1 in the same plane.

As shown in FIG. 14, when the second sub transistor T1_2 includes the double gate electrode (top gate electrode 304*a* and bottom gate electrode 304*b*), mobility of a driving current may increase as the number of gate electrodes increases.

Figure 15:
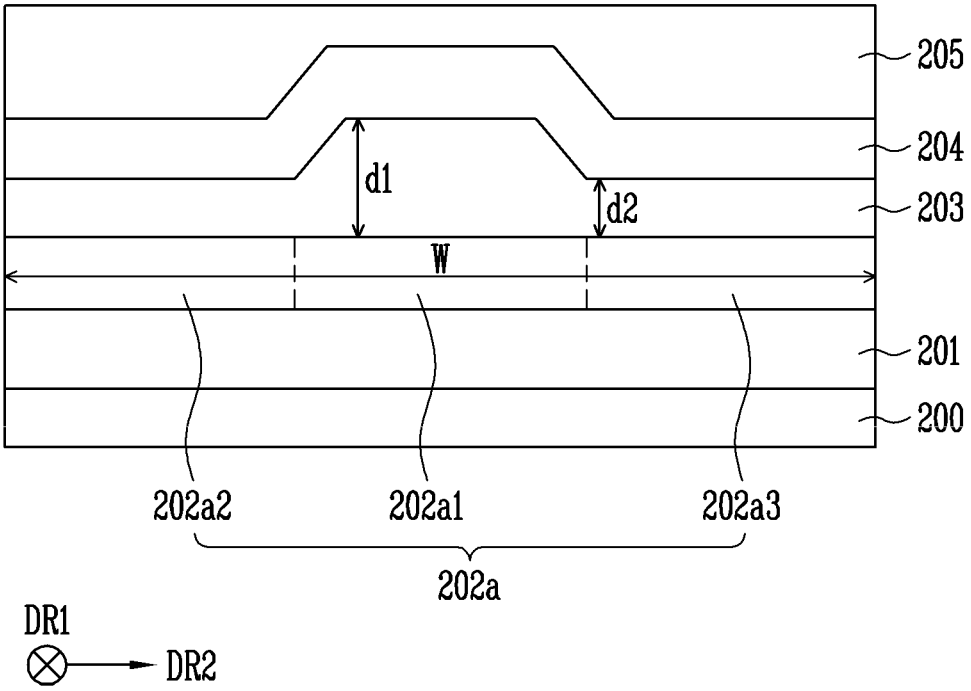
FIG. 15 is a cross-sectional view taken along a line R-R' of FIG. 4.

FIG. 15 is a cross-sectional view taken along a line R-R' of FIG. 4.

Compared with FIG. 4, in the cross-sectional view of the first transistor shown in FIG. 15, the second direction DR2 corresponds to a horizontal direction in the drawing along the line R-R'. Therefore, it may be assumed that a current flow exists along the first direction DR1.

Referring to FIG. 15, the channel region 202*a* of the active layer pattern 202 includes the first edge region 202*a*2 and the second edge region 202*a*3 positioned on both sides based on the channel width W, and the bulk region 202*a*1 positioned between the first edge region 202*a*2 and the second edge region 202*a*3 (refer to the plan view of FIG. 5 together).

At this time, the first insulating film 203 may be formed so that a thickness d1 of a region overlapping the bulk region 202*a*1 is thicker than a thickness d2 of a region overlapping the first edge region 202*a*2 or the second edge region 202*a*3.

As described above, when the thickness of the region overlapping the bulk region 202*a*1 is relatively thick in the first insulating film 203, the disclosure may have a strong characteristic with respect to the HCl phenomenon, and a driving current decrease may be prevented or reduced.

For example, in a process method of the first transistor T1 according to FIG. 15, first, a buffer layer 201 may be formed on the base layer 200, amorphous silicon (a-Si) may be deposited on the buffer layer 201, and then the amorphous silicon may be changed to polysilicon through a crystallization process using a laser. Next, the active layer pattern 202 may be formed through a photolithography process on the polysilicon, and the first insulating film 203 may be formed on the formed active layer pattern 202 through chemical vapor deposition (CVD). At this time, the first edge region 202*a*2 and/or the second edge region 202*a*3 of the first insulating film 203 may be partially scraped off or removed by using a hard mask to form the first insulating film 203 having a relatively thick thickness in a region overlapping the bulk region 202*a*1. Next, the gate electrode 204 may be formed by depositing a gate layer on the first insulating film 203 and leaving only a portion of the gate layer through a photolithography process. Next, after forming the source region and the drain region in the active layer pattern 202 through ion doping, the second insulating film 205 may be formed.

The referred drawings and the detailed description of the disclosure described are merely example embodiments of the disclosure, are used for merely describing aspects of some example embodiments the disclosure, and are not intended to limit the meaning and the scope of embodiments according to the disclosure as defined in the claims and their equivalents. Therefore, those skilled in the art may understand that various modifications and equivalent other embodiments are possible from these. Thus, the true scope of the disclosure should be determined by the technical spirit of the appended claims and their equivalents.

What is claimed is:

1. A display device comprising:

a pixel unit including a plurality of pixels;

a scan driver having a plurality of stages and configured to supply a scan signal to the pixel unit; and a light emission control driver having a plurality of stages and configured to supply a light emission control signal to the pixel unit, wherein a first transistor of a plurality of transistors included in at least one of the stages of the scan driver or the stages of the light emission control driver comprises:

an active layer pattern on a base layer, and including a channel region forming a channel, and first and second regions on opposite sides of the channel region; and a gate electrode spaced apart from the active layer pattern with a first insulating film therebetween, and overlapping the channel region, and a channel width of the channel region is narrower than a channel width of at least one of remaining transistors of the plurality of transistors.

2. The display device according to claim 1, wherein the first transistor includes a first sub transistor connected in parallel with a second sub transistor, a channel width of the first sub transistor is narrower than a channel width of the second sub transistor, and a channel length of the first sub transistor is shorter than a channel length of the second sub transistor.

3. The display device according to claim 2, wherein the first sub transistor and the second sub transistor share the gate electrode, and the gate electrode includes a first gate region having a first width corresponding to the channel length of the first sub transistor and a second gate region having a second width corresponding to the channel length of the second sub transistor and longer than the first width.

4. The display device according to claim 3, wherein at least one of the first region or the second region is divided into a region of the first sub transistor and a region of the second sub transistor spaced apart from the region of the first sub transistor.

5. The display device according to claim 3, wherein the first sub transistor and the second sub transistor share a single first region and share a single second region.

6. The display device according to claim 1, wherein the first transistor includes a first sub transistor, and a second sub transistor and a third sub transistor having a common gate electrode and connected in series.

7. The display device according to claim 6, wherein a channel width of the first sub transistor is narrower than a channel width of the second sub transistor or a channel width of the third sub transistor.

8. The display device according to claim 6, wherein a channel width of the second sub transistor is equal to a channel width of the third sub transistor.

9. The display device according to claim 6, wherein channel lengths of the first sub transistor, the second sub transistor, and the third sub transistor are less than a channel length of at least one of the remaining transistors.

10. The display device according to claim 6, wherein the first sub transistor, the second sub transistor, and the third sub transistor share the gate electrode, and the gate electrode comprises:

a first gate region having a first width corresponding to a channel length of the first sub transistor;

a second gate region having a second width corresponding to a channel length of the second sub transistor; and a third gate region having a third width corresponding to a channel length of the third sub transistor.

11. The display device according to claim 10, wherein the gate electrode further comprises a fourth gate region connecting the first gate region, the second gate region, and the third gate region to each other.

12. The display device according to claim 11, wherein the first sub transistor and the second sub transistor share a single first region, and the first sub transistor and the third sub transistor share a single second region.

13. The display device according to claim 11, wherein the gate electrode includes a portion having a shape of an uppercase alphabetic letter CT'.

14. The display device according to claim 1, wherein the first transistor comprises:

a first sub transistor connected in parallel with a second sub transistor; and a third sub transistor connected in series with the first sub transistor and the second sub transistor.

15. The display device according to claim 14, wherein a channel width of the first sub transistor and the second sub transistor is narrower than a channel width of the third sub transistor.

16. The display device according to claim 15, wherein channel lengths of the first sub transistor, the second sub transistor, and the third sub transistor are less than a channel length of at least one of the remaining transistors.

17. The display device according to claim 15, wherein the first sub transistor, the second sub transistor, and the third sub transistor share the gate electrode, and the gate electrode comprises:

a first gate region overlapping a channel region of the first sub transistor and a channel region of the second sub transistor; and a second gate region overlapping a channel region of the third sub transistor.

18. The display device according to claim 17, wherein the second gate region is connected to the first gate region.

19. The display device according to claim 1, wherein the first transistor includes a first sub transistor and a second sub transistor connected in parallel with each other, the second sub transistor further includes a bottom gate electrode spaced apart from the gate electrode, the first insulating film, and the active layer pattern, and a channel width of the first sub transistor is narrower than a channel width of the second sub transistor.

20. A display device comprising:

a pixel unit including a plurality of pixels;

a scan driver having a plurality of stages to supply a scan signal to the pixel unit; and a light emission control driver having a plurality of stages to supply a light emission control signal to the pixel unit, wherein a first transistor of a plurality of transistors included in at least one of the stages of the scan driver or the stages of the light emission control driver comprises:

an active layer pattern including a channel region on a buffer layer to form a channel, and first and second regions on opposite sides of the channel region; and a gate electrode spaced apart from the active layer pattern with a first insulating film therebetween, and overlapping the channel region, the channel region includes a first edge region and a second edge region at opposite side surfaces of the channel region based on a channel width, and a bulk region between the first edge region and the second edge region, and the first insulating film has a thickness of a region overlapping the bulk region, which is thicker than a thickness of a region overlapping with the first edge region or the second edge region.

* * * * *